US008841843B2

(12) United States Patent
Kato et al.

(10) Patent No.: US 8,841,843 B2
(45) Date of Patent: Sep. 23, 2014

(54) SHORT ARC TYPE MERCURY LAMP

(71) Applicant: Ushio Denki Kabushiki Kaisha, Tokyo (JP)

(72) Inventors: Masaki Kato, Himeji (JP); Yukio Yasuda, Himeji (JP)

(73) Assignee: Ushio Denki Kabushiki Kaisha, Chiyoda-Ku, Tokyo (JP)

( * ) Notice: Subject to any disclaimer, the term of this patent is extended or adjusted under 35 U.S.C. 154(b) by 0 days.

(21) Appl. No.: 13/934,646

(22) Filed: Jul. 3, 2013

(65) Prior Publication Data

US 2014/0015404 A1 Jan. 16, 2014

(30) Foreign Application Priority Data

Jul. 10, 2012 (JP) ..... 2012-154208

(51) Int. Cl.
*H01J 17/04* (2012.01)
*H01J 61/04* (2006.01)
*H01J 61/06* (2006.01)

(52) U.S. Cl.
CPC ..... *H01J 61/06* (2013.01)
USPC ..... 313/620; 313/631

(58) Field of Classification Search
CPC ..... H01J 61/827; H01J 61/822; H01J 61/16; H01J 61/20; H01J 61/0672; H01J 61/06
USPC ..... 313/620, 571, 631, 632, 639, 642
See application file for complete search history.

(56) References Cited

U.S. PATENT DOCUMENTS

| | | | | |
|---|---|---|---|---|
| 6,437,508 | B1 * | 8/2002 | Sugihara et al. | 313/632 |
| 7,973,476 | B2 | 7/2011 | Koger et al. | 313/571 |
| 2002/0163307 | A1 * | 11/2002 | Serizawa et al. | 313/642 |
| 2004/0075390 | A1 * | 4/2004 | Kikuchi et al. | 313/631 |
| 2005/0194904 | A1 * | 9/2005 | Hosoya et al. | 313/631 |

FOREIGN PATENT DOCUMENTS

| | | |
|---|---|---|
| JP | 2000-231903 A | 8/2000 |
| JP | 2003-234083 A | 8/2003 |
| JP | 2010-514118 A | 4/2010 |

* cited by examiner

*Primary Examiner* — Nimeshkumar Patel
*Assistant Examiner* — Glenn Zimmerman
(74) *Attorney, Agent, or Firm* — Fitzpatrick, Cella, Harper & Scinto

(57) ABSTRACT

A short arc type mercury lamp structure has Hg and a rare gas which are enclosed inside a light-emitting tube. Kr is enclosed as the rare gas. It is possible to realize the initial intensity of radiation at the same level as in the case in which Ar is enclosed and prevent a sudden decrease in the intensity of radiation when the lamp is lighted for a long time. The longevity of the lamp is greatly increased than that of a lamp in which Ar is enclosed. The anode satisfies the formula:

$$1-r/(d_0\times\tan\theta)\geq 0.66,$$

where r (mm) is the radius of the leading end surface of the anode, θ(°) is the angle between the electrode axis and the taper surface in the axial cross-section of the anode, and $d_0$ (mm) is the inter-electrode distance.

1 Claim, 8 Drawing Sheets

| | Enclosed gas | Radius of leading end of anode r(mm) | Angle of incline of tapered surface θ(°) | $d/d_0$ | Initial intensity of illumination (relative value) | Judgment of initial intensity of illumination | Persistency ratio of intensity of illumination | Judgment of persistency ratio | Synthetic judgment |
|---|---|---|---|---|---|---|---|---|---|
| Lamp 1 | Ar | 6 | 60 | 0.59 | 100 | ○ | Sudden decrease | X | X |
| Lamp 2 | Ar | 3.5 | 60 | 0.76 | 106 | ○ | Sudden decrease | X | X |
| Lamp 3 | Ar | 5 | 60 | 0.66 | 103 | ○ | Sudden decrease | X | X |
| Lamp 4 | Ar | 6 | 65 | 0.67 | 102 | ○ | Sudden decrease | X | X |
| Lamp 5 | Ar | 6 | 55 | 0.51 | 93 | X | Sudden decrease | X | X |
| Lamp 6 | Kr | 6 | 60 | 0.59 | 96 | X | No sudden decrease | ○ | X |
| Lamp 7 | Kr | 3.5 | 60 | 0.76 | 103 | ○ | No sudden decrease | ○ | ○ |
| Lamp 8 | Kr | 5 | 60 | 0.66 | 100 | ○ | No sudden decrease | ○ | ○ |
| Lamp 9 | Kr | 6 | 65 | 0.67 | 100 | ○ | No sudden decrease | ○ | ○ |

$$d/d_0=1-r/(d_0 \times \tan \Theta)$$

FIG. 5

SHORT ARC TYPE MERCURY LAMP

CROSS REFERENCE TO RELATED APPLICATION(S)

This application claims the benefit of Japanese Patent Application No. JP2012-154208, filed Jul. 10, 2012, which is hereby incorporated by reference in its entirety into this application.

BACKGROUND OF THE INVENTION

1. Technical Field

The present invention relates generally to a short arc type mercury lamp and, more particularly, to a short arc type mercury lamp in which Hg and a rare gas are enclosed inside a light-emitting tube.

2. Description of the Related Art

Typically, short arc type mercury lamps in which Hg and a rare gas are enclosed are used as a light source for exposing semiconductor, a liquid crystal display (LCD) or the like to light.

Japanese Laid-Open Patent Publication 2003-234083 (Patent Document 1) discloses examples of the short arc type mercury lamp each of which is configured by enclosing each of Ar, Kr and Xe therein as a rare gas.

According to this document, in the lamps in which the rare gases are enclosed under the same pressure, when the lamps are lighted under the same conditions, it is suggested that the lamp in which Ar is enclosed can acquire the highest intensity of radiation from emitted light.

Describing in brief, the reason why the intensity of radiation varies depending on the sort of the rare gases is caused by the different thermal conductivities of the gases. Since the mercury arc can contract at a higher thermal conductivity, the arc is elongated, thereby increasing the current density. This can consequently realize a light source having higher luminance. The sequence of heat conductivity is Ar>Kr>Xe, and the intensity of radiation on an irradiated surface increases in this sequence.

Referring to the schematic view of the arc in FIG. 7A and FIG. 7B, the size of an arc of a lamp A in which Ar gas is enclosed is compared with the size of an arc of a lamp B in which Kr gas is enclosed. In the lamp A in which Ar gas is enclosed, between a cathode and an anode, the arc slightly spreads in the direction toward the anode but its width (diameter) is restricted. Accordingly, the arc is contracted, more particularly, contracted about the leading end of the anode. In contrast, in the lamp B in which the Kr is enclosed, the arc that extends from the leading end surface of the cathode is continuously spread toward the anode. Accordingly, almost the entire area of the leading end surface of the anode, i.e. a wider area, is subjected to the arc.

In this point of view, it is typical that Ar is enclosed in the short arc type mercury lamp in the related art in order to realize high luminance.

However, in the short arc type mercury lamp in which Ar gas is enclosed, in particular, in the lamp in which Ar is enclosed at a positive pressure of 0.25 MPa or greater, the persistency ratio of intensity of radiation may suddenly decrease in some cases when a light-on time exceeds a predetermined time, for example, 1500 hours.

When the inventors inspected the reason for the sudden decrease in the intensity of radiation of the lamp, it became clear that no problem occurs when the lamp is lighted on at a lamp current of 150 A or less but the decrease in the intensity of radiation became significant when the lamp current was 180 A or greater.

In the lamp in which the persistency ratio of the intensity of radiation is decreased, as shown in FIG. 8, concaves and convexes X formed on the leading end surface of the anode were observed. The reason for this is considered to be that, since the arc is contracted by the Ar gas, the arc is locally concentrated at the leading end surface of the anode, such that the current density is increased and the leading end is overheated, thereby generating thermal stress, which then deforms the leading end surface of the anode.

When the leading end of the anode is deformed, the arc is concentrated on the deformed portion, thereby intensifying overheating. The intensifying overheating evaporates tungsten, or the anode material, which is then deposited on the light-emitting tube, thereby causing blackening to progress. It is regarded that this series of phenomenon suddenly progresses after the passage of a certain time, thereby suddenly lowering the intensity of radiation.

This phenomenon is not observed in any lamp in which Kr or Xe is enclosed instead of Ar.

In other words, when it is intended to increase simply the longevity of the lamp, it is possible to overcome this problem by using a rare gas, for example, Kr gas, that has lower thermal conductivity than Ar.

However, in this case, as described above, it is impossible to contract the arc in the elongated shape as in the case of using Ar, thereby failing to achieve a high intensity of radiation on the irradiated surface. This leads to another problem in that the initial intensity of radiation as required cannot be achieved.

RELATED ART DOCUMENT

Patent Document

Japanese Laid-Open Patent Publication No. 2003-234083

SUMMARY OF THE INVENTION

Accordingly, the present invention has been made keeping in mind the above problems occurring in the prior art, and an object of the present invention is to provide a short arc type mercury lamp in which Hg and a rare gas are enclosed inside a light-emitting tube, and which, when Kr is enclosed as the rare gas, can realize the initial intensity of radiation at the same level as in the case in which Ar is enclosed, prevent a sudden decrease in the intensity of radiation when the lamp is lighted for a long time, and realize the persistency ratio of the intensity of radiation at a high-level for a long time.

In order to overcome the foregoing problem, provided is a short arc type mercury lamp, in which a cathode and an anode are disposed inside a light-emitting tube such that the cathode and the anode oppose each other, and Hg and a rare gas are enclosed inside the light-emitting tube, characterized in that the enclosed rare gas comprises Kr, the anode has a taper portion at a leading end side and a flat leading end surface on a leading end thereof, and the anode satisfies the following formula:

$$1-r/(d_0\times\tan\theta)\geq 0.66,$$

where r (mm) is a radius of the leading end surface of the anode, θ (°) is an angle between an electrode axis and the taper surface in an axial cross-section of the anode, and $d_0$ (mm) is the distance between the cathode and the anode.

According to the present invention, in the short arc type mercury lamp in which Kr is enclosed as a rare gas, it is impossible to acquire a high current density, since the arc spreads because the thermal conductivity of Kr is lower than the thermal conductivity of Ar. However, the relationship between the configuration of the leading end portion of the anode and the distance between the anode and the cathode satisfies $1-r/(d_0 \times \tan\theta) \geq 0.66$, where r (mm) is the radius of the leading end surface of the anode, θ (°) is the angle between the electrode axis and the taper surface in the axial cross-section of the anode, and $d_0$ (mm) is the distance between the cathode and the anode. This makes it possible to increase the extracted amount of emitted light without contracting the arc, thereby achieving the initial intensity of radiation at the level the same as or higher than that of a lamp in which Ar is enclosed.

In addition, since Kr is enclosed as the rare gas, the action in which the arc is contracted to increase the current density is reduced than the short arc type mercury lamp in which Ar is enclosed. It is possible to reduce the concentration of the arc on the leading end of the anode and reduce the evaporation tungsten, or the anode material using the function in which the arc is not contracted, thereby preventing the intensity of radiation from suddenly decreasing.

As set forth above, according to the present invention, it is also possible to produce a lamp which has the initial intensity of radiation that is the same as or higher than that of the case in which Ar is enclosed when Kr is enclosed as the rare gas. In addition, since the anode has a certain configuration, there is no sudden decrease in the persistency ratio of the intensity of radiation, and the longevity of the lamp is increased.

BRIEF DESCRIPTION OF THE DRAWINGS

The above and other objects, features and advantages of the present invention will be more clearly understood from the following detailed description taken in conjunction with the accompanying drawings, in which:

FIG. 5 is a table showing the arranged results of the intensity of radiation at the initial stage and the persistency ratio of the intensity of radiation of Lamp 1 to Lamp 9 which are fabricated by varying the shape of electrodes and the sort of enclosed gas;

DESCRIPTION OF THE PREFERRED EMBODIMENTS

Figure 1:
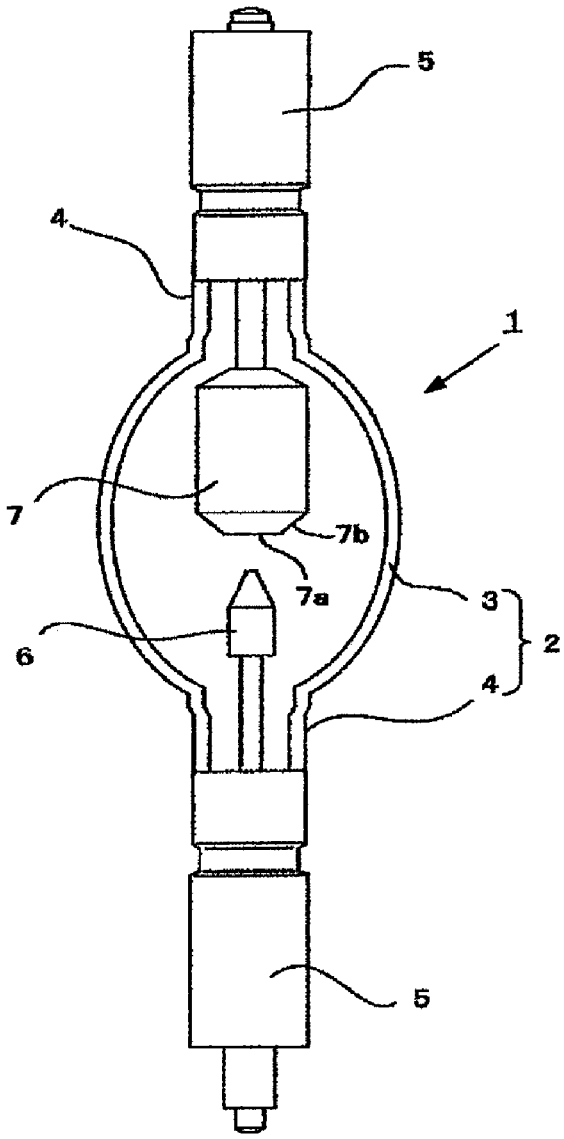
FIG. 1 is an overall configuration view showing a short arc type mercury lamp according to the present invention.

Reference now should be made to the drawings, in which the same reference numerals are used throughout the different drawings to designate the same or similar components.

FIG. 1 is an overall configuration view showing a short arc type mercury lamp according to the present invention.

The short arc type mercury lamp 1 includes a light-emitting tube 2 which is made of a transparent material, for example, a quartz glass. The light-emitting tube 2 includes a bulged light-emitting part 3 formed in the central portion thereof and cylindrical enclosing parts 4 and 4 which extend in the outward direction from both ends of the light-emitting part 3. In addition, jigs 5 and 5 are connected to ends of the enclosing parts 4 and 4.

In addition, inside the light-emitting tube 2, Hg and Kr are enclosed and a pair of electrodes, including a cathode 6 and an anode 7, are disposed such that they face each other. The cathode 6 and the anode 7 are mainly made of tungsten, and are spaced apart a predetermined distance from each other at the center of the light-emitting part 3.

Hg is a light-emitting material for emitting ultraviolet (UV) radiation, and is enclosed at a ratio ranging, for example, from 0.8 to 5.0 mg/cm$^3$.

In addition, according to the present invention, Kr is employed as a rare gas that is enclosed, and is enclosed preferably by 0.25 Mpa (2.5 atm) or greater.

Since this short arc type mercury lamp constitutes a light source device together with a reflecting mirror having the shape of a concave surface which captures reflected light, light emitted from the lamp is collected by directing reflected light toward an optical system.

Figure 7A:
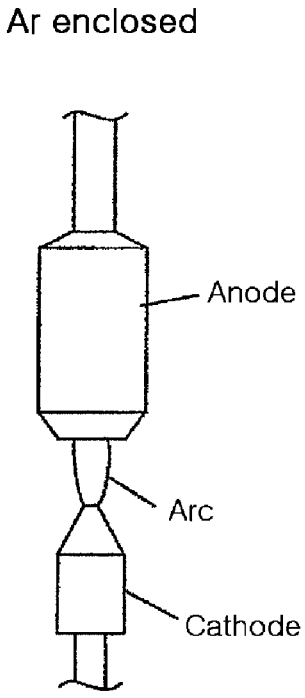
FIG. 7A and FIG. 7B are views schematically showing the size of an arc from a lamp in which Ar is enclosed and the size of an arc from a lamp in which Kr is enclosed.
Figure 7B:
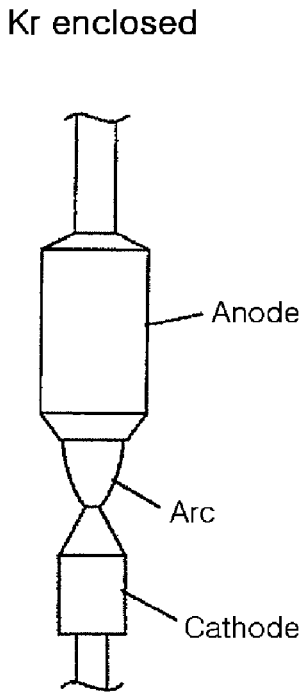
Figure 8:
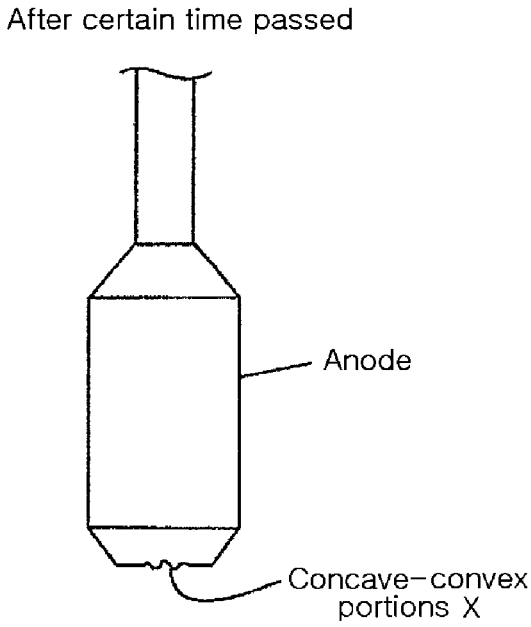
(PRIOR ART) FIG. 8
FIG. 8 is a view schematically showing a modified configuration of the leading end of an anode of a short arc type mercury lamp of the related art in which Ar is enclosed.

However, as described above with reference to FIG. 7A and FIG. 7B, in the short arc type mercury lamp of the related art in which Ar is enclosed, when the rare gas is simply substituted with Kr, the arc is spread. Therefore, when the lamp is mounted on the optical system as mentioned above, the amount of radiation that converges to the focal point of the mirror decreases when collecting light from the lamp to the reflecting mirror. This theoretically leads to a decreased efficiency of the lamp.

However, according to the present invention, the leading end of the anode has a configuration that satisfies predetermined requirements, thereby making it possible to extract light that is blocked by the anode and cannot be used. This consequently compensates for the amount of radiation that is reduced by the spreading of the arc due to the application of Kr as the enclosed gas. Accordingly, it is possible to use radiation light at an efficiency that is comparable with that of the related-art short arc type mercury lamp in which Ar is enclosed.

However, in this type of short arc type mercury lamp, the leading end surface of the leading end portion of the cathode which has a sufficiently smaller diameter than the anode is used in order to produce a high current density and high luminance. In addition, the angle of taper of the leading end is also set in the range from 40 to 70°, which is smaller than that of the anode. Therefore, a change in the configuration of the cathode contributes little to an increase in the efficiency of use. Accordingly, the present invention has been made in consideration of the configuration of the anode, and is intended to improve the efficiency of use of light.

A detailed description will be given below of the configuration of the anode according to the present invention.

Figure 2:
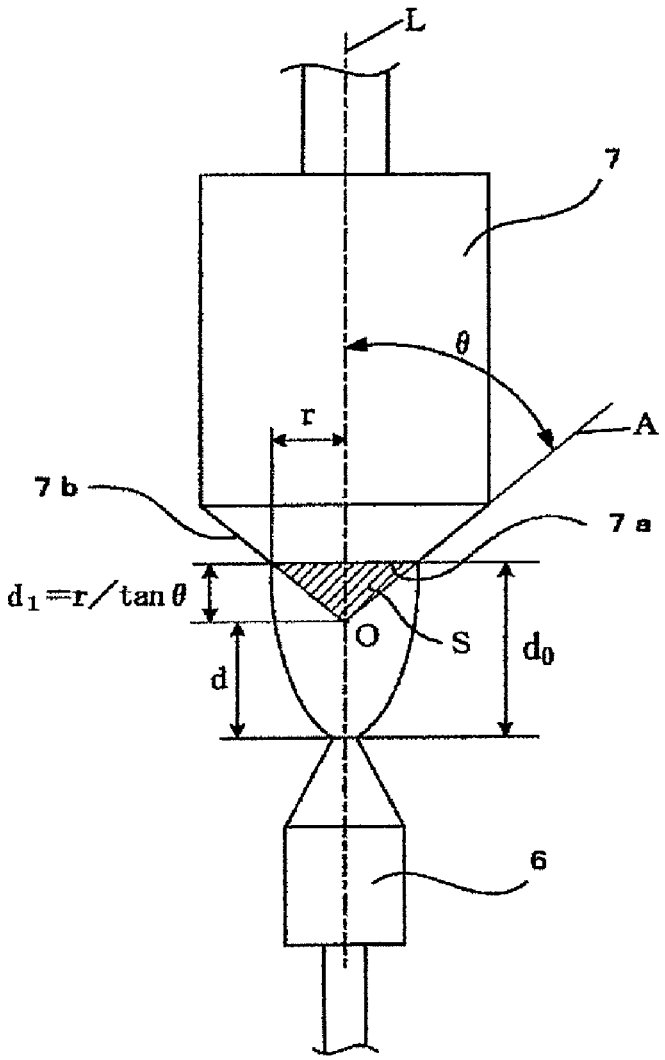
FIG. 2 is a partially enlarged view showing an anode and a cathode.

FIG. 2 is a partially enlarged view showing the cathode 6 and the anode 7. In this lamp, the anode 7 has a taper surface 7*b* at the leading end side thereof and a flat leading end surface 7*a* on the leading end of the taper surface 7*b*, i.e. the leading end of the anode 7. The leading end surface 7*a* is disposed so as to oppose the cathode 6.

However, the distance $d_0$ between the pair of the cathode 6 and the anode 7 is regulated depending on the specification such as a lamp input or the like in this type of short arc type mercury lamp. The inter-electrode distance $d_0$ (mm) is constant for the same type of lamps.

Thus, the configuration of the anode 7 that is changeable in consideration of dimensions is the size of the leading end surface 7*a* of the anode, i.e. the radius r (mm) and the angle θ (°), hereinafter referred to as the angle of incline) that is defined by the taper surface (the inclined surface on the leading end of the anode) 7*b* and the axis L of the electrode on the axial cross-sectional surface. Therefore, when these conditions are changed, inspection is made about the configuration of the anode in which the efficiency of the lamp in which Kr is enclosed becomes good. In addition, describing the angle of incline θ of the taper surface 7*b*, when the intersection point between the electrode axis L and a segment of line A along the ridge of the taper surface 7*b* is set O, the angle of incline is the angle defined by the electrode axis L and the segment of line A about the intersection point O as a summit.

In addition, in FIG. 2, when reflected light is present in an area S (hereinafter referred to as an imaginary leading end area of the anode) expressed by hatching having the shape of an isosceles triangle that is drawn with the leading end surface 7*a* of the anode as a base and the intersection point O of the electrode axis L and the segment of line A as a summit, the reflected light forms a shade of the body of the anode, thereby creating light vignetting, and is not emitted to the outside. Accordingly, the reflected light present in that area cannot be used in practice. In other words, it is possible to increase the amount of light emitted from the arc by decreasing the imaginary leading end area S of the anode. In addition, although this area S is expressed on a flat area in the figure, it is a conical area that has the leading end surface 7*a* as a base, the intersection point O as a summit, and the axis L of the electrode as an axis of rotation.

In FIG. 2, when the inter-electrode distance $d_0$ is expressed by dividing it at the intersection point O of the segment of line A and the electrode axis L, this distance $d_0$ becomes the sum of the distance d from the leading end of the cathode 6 to the intersection point O and the distance $d_1$ from the leading end of the anode 7 to the intersection point O. The distance $d_1$ (mm) can be expressed by a function of a radius r (mm) of the leading end surface 7*a* of the anode: $d_1=r/\tan\theta$.

Here, the distance d from the leading end of the cathode to the intersection point O is an imaginary inter-electrode distance that satisfies a solid angle $\Omega=2\pi\cos\theta$ or a greater angle where light emitted from the point O on the optical axis can be effectively used without being blocked at the anode. The greater the ratio of the imaginary inter-electrode distance d to the actual inter-electrode distance $d_0$ is, the greater the amount of emitted light that can be theoretically used becomes.

The inter-electrode distance $d_0$ is $d_0=r/\tan\theta+d$ due to $d_0=d_1+d$. Here, the ratio $d/d_0$ of the distance d from the leading end of the cathode to the intersection point O to the inter-electrode distance $d_0$ is expressed by the following Formula:

$$d/d_0=1-r/(d_0\times\tan\theta) \qquad \text{Formula 1}$$

where r is the radius (mm) of the leading end surface of the anode, θ is the angle of incline 0° of the taper surface of the anode to the electrode axis, $d_0$ is the distance between the cathode and the anode (inter-electrode distance) (mm), and d is the imaginary inter-electrode distance (mm) that satisfies a solid angle $\Omega=2\pi\cos\theta$ or a greater angle where light emitted from the point O on the optical axis can be effectively used without being blocked at the anode.

As described above, when the dimension (radius r) of the leading end surface 7*a* of the anode and the angle θ between the taper surface 7*b* and the electrode axis L are variously changed while the inter-electrode distance $d_0$ is constant, it is possible to induce the imaginary inter-electrode distance d in FIG. 2 where light emitted from the point O on the optical axis can be effectively used without being blocked by the anode 7.

Figure 3:
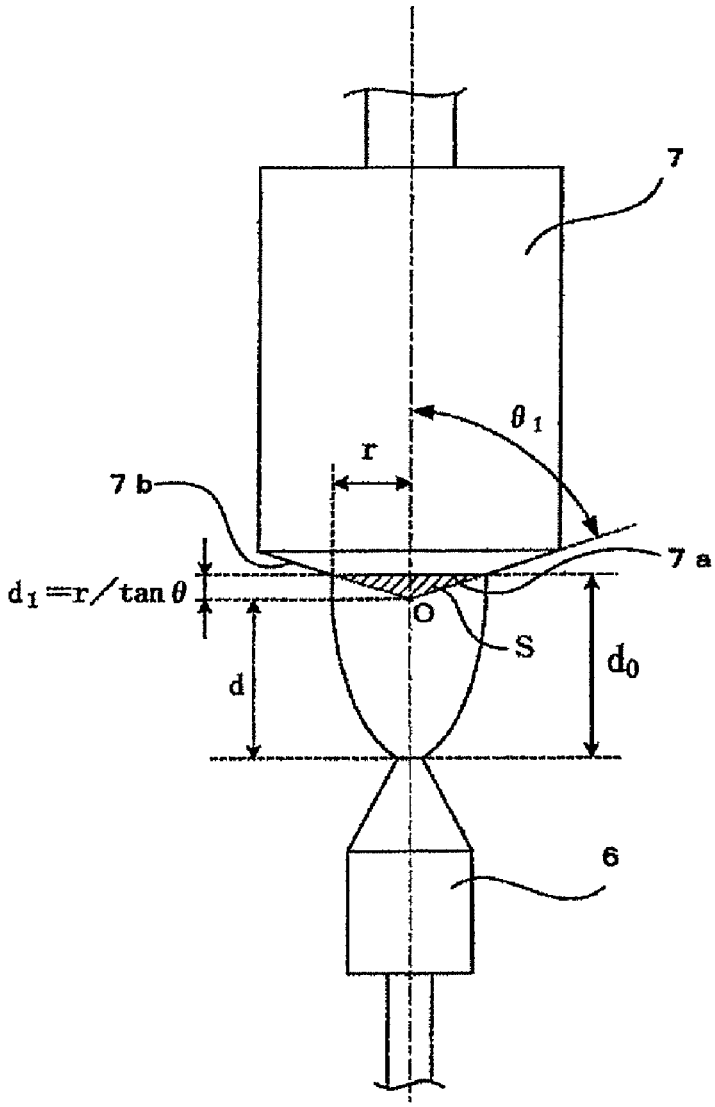
FIG. 3 is a view showing a configuration in which the diameter of the leading end of the anode is reduced.

FIG. 3 is a modification of the configuration of the anode shown in FIG. 2, in which the angle $\theta_1$ of the taper surface 7*b* about the electrode axis L is further increased without a change in the radius r (mm) of the leading end surface 7*a* of the anode ($\theta_1>\theta$).

Of course, also in this embodiment, the imaginary inter-electrode distance d (mm) that satisfies an at least solid angle $\Omega=2\pi\cos\theta_1$ where light emitted from the point O on the optical axis can be effectively used without being blocked at the anode is $d=d_0-(r/\tan\theta_1)$.

As is apparent when the anode structure shown in FIG. 3 is compared with the anode structure shown in FIG. 3, the imaginary leading end area S of the anode is decreased as the angle of incline $\theta_1$ of the taper surface 7*b* with respect to the electrode axis L is increased. Accordingly, the imaginary inter-electrode distance d (mm) can be formed at a great ratio.

Figure 4:
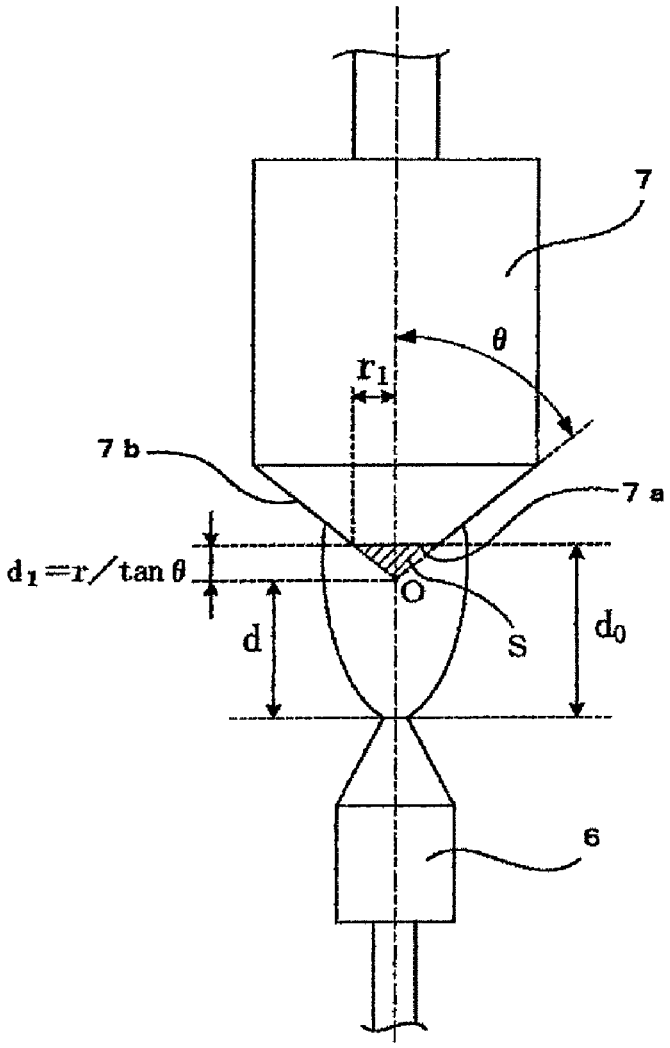
FIG. 4 is a view showing a configuration in which the angle of taper of the anode is increased.

FIG. 4 is a modification of the configuration of the anode shown in FIG. 2, in which the radius $r_1$ (mm) of the leading end surface 7*a* of the anode is further decreased ($r_1<r$) without a change in the angle θ of the taper surface 7*b*.

Of course, also in this embodiment, the imaginary inter-electrode distance d (mm) that satisfies an at least solid angle $\Omega=2\pi\cos\theta$ where light emitted from the point O on the optical axis can be effectively used without being blocked at the anode is $d=d_0-(r_1/\tan\theta)$.

As is apparent when the anode structure shown in FIG. 4 is compared with the anode structure shown in FIG. 2, the imaginary leading end area S of the anode is decreased as the radius $r_1$ (mm) of the leading end surface 7*a* of the anode is decreased. Accordingly, the imaginary inter-electrode distance d (mm) can be formed at a great ratio.

As described above, based on the design criteria of the anode shown in FIG. 2 to FIG. 4, as for the short arc type mercury lamp in which Kr is enclosed, inspection was made about the radius r (mm) of the leading end surface 7*a* of the anode and the size (range) of the angle θ (°) that is defined by the taper surface 7*b* and the electrode axis where the initial intensity of radiation is at least 100% with respect to that of the related-art short arc type mercury lamp in which Ar is enclosed.

In addition, in order to increase $d/d_0$, as described above, there are two methods that include the method of increasing θ and reducing r. When θ=90° or r=0 is satisfied, $d/d_0$ theoretically becomes 1, which is the maximum.

However, in an actual lamp, $d/d_0=1$ is not obtained. The reason for this is as follows.

Referring to FIG. 1, first, as for the angle of incline of the taper surface 7*b* at the leading end of the anode, when θ is 70° or greater, convection from the anode 7 inside the light-emitting tube 2 cannot be directed upward in the light-emitting tube 2 since a horizontal stream is a main stream. Therefore, evaporated tungsten tends to be deposited on the central portion of the light-emitting tube (bulb) 2, thereby deteriorating the persistency ratio of the intensity of radiation.

Next, as for the size of the radius r (mm) of the leading end surface 7*a* of the anode, when the current density of the leading end surface 7*a* of the anode is 10 A/mm$^2$ or greater, the electrode tends to melt. This is consequently deposited on the light-emitting tube 2, thereby deteriorating the persistency ratio of the intensity of radiation, as is empirically known.

From this reason, it is necessary to properly select the radius r and the angle of incline θ of the taper surface within the upper limit that does not deviate from the range that is applicable to this type of short arc type mercury lamp.

Therefore, the inventors have conducted a verification experiment for a configuration with which high initial intensity of radiation can be realized by changing parameters within an available range without departing from the numerical range of the anode that is empirically determined.

The specification of the lamp that was used in the verification experiment is presented as follows.

Lamp Specification (1)

Material of light-emitting tube: quartz glass

Material of anode: tungsten

Diameter of maximum diameter portion: ϕ40 mm

Inter-electrode distance: 8.5 mm

Input power: 7.5 kW

Lamp current: 200 A

Hg density: 2.4 mg/cc

Sort of rare gas: Ar or Kr

Enclosure pressure (converted into positive pressure): 0.46 MPa (4.5 atm)

Using the above-described specification, Lamp 1 to Lamp 9 were fabricated by varying the sort of the rare gas, the radius r (mm) of the leading end surface of the anode, and the angle of incline θ of the taper portion of the leading end of the anode.

Lamp 1 to Lamp 5 are short arc type mercury lamps in all of which Ar gas is enclosed.

Lamp 1 is a lamp according to the related art, in which the radius r of the leading end surface of the anode is 6 mm, and the angle of incline θ of the taper portion of the leading end is 60°.

As for Lamp 1, $d/d_0$ was produced by applying Formula 1 above, and the result was 0.59.

After that, Lamp 2 to Lamp 5 were fabricated by varying r (mm), θ (°) and $d/d_0$, i.e. $1-r/(d_0\times\tan\theta)$, in the same fashion, the results of verifying the initial intensity of radiation and the persistency ratio of the intensity of radiation are presented in FIG. 5.

In FIG. 5, the initial intensity of radiation of Lamp 2 to Lamp 5 are expressed as relative values with respect to the intensity (100) of Lamp 1. Referring to the results, except for Lamp 5, the initial intensity of radiation was equal to or greater than that of Lamp 1, and there were no problems as for the initial intensity of radiation of Lamp 2 to Lamp 4

However, referring to the persistency rate of the intensity of radiation, all of Lamp 1 to Lamp 5 experienced a sudden decrease in the intensity of radiation after the passage of a certain time, and a long longevity was not be obtained.

Next, Lamp 6 to Lamp 9 in FIG. 5 are short arc type mercury lamps in which Kr is enclosed as a rare gas according to the present invention. A description will be given below of inspection on Lamp 6 to Lamp 9.

The configuration of the anode of Lamp 6 was the same as that of Lamp 1 of the related art in which Ar is enclosed. Specifically, the radius r of the leading end surface 7*a* of the anode was 6 mm, and the angle of incline θ of the taper surface 7*b* of the leading end was 60°. In Lamp 6, $d/d_o$ was 0.59, which is the same as that of Lamp 1.

In Lamp 7 and Lamp 8, the angle of incline θ of the taper surface of the leading end of the anode was 60°, which is the same as that of Lamp 1. The radius r of the leading end surface had different values, i.e. r was 3.5 mm in Lamp 7 and 5 mm in Lamp 8. In Lamp 7 and Lamp 8, values of $d/d_0$ were 0.76 and 0.66, respectively.

Lamp 9 was fabricated by setting the radius r of the leading end surface to 6 mm, which is the same as that of Lamp 1, but the angle of incline θ of the taper surface to 65°. In the case of Lamp 9, $d/d_0$ is 0.67.

Initial Intensity of Radiation

In Lamp 6, the initial intensity of radiation was lower than that of Lamp 1 since Kr was used, and thus the same intensity of radiation was not obtained. This proves that, when the configuration of the anode is the same, a sufficient initial intensity of radiation cannot be obtained from a lamp in which Kr is enclosed when compared to a lamp in which Ar is enclosed.

In Lamp 7, $d/d_0$ was 0.76. As described above, theoretically, the amount of available light was increased compared with that of Lamp 1 or Lamp 6. Referring to the actual results, the initial intensity of radiation of Lamp 7 was 103 as a relative value. Accordingly, the intensity of radiation greater than that of Lamp 1 was obtained.

Also in Lamp 8, the initial intensity of radiation was 100 as a relative value, and the intensity of radiation the same as that of Lamp 1 was obtained.

In addition, also in Lamp 9, the initial intensity of radiation was 100 as a relative value. It was proved that Lamp 9 can obtain the initial intensity of radiation that is the same as that of Lamp 1.

As set forth above, it can be appreciated that Lamp 7 to Lamp 9 can obtain the initial intensity of radiation that is the same as or greater than Lamp 1 of the related art.

Persistency Ratio of Intensity of Radiation

After that, the persistency ratio of the intensity of radiation was verified. In any one of Lamp 6 to Lamp 9 in which Kr was enclosed, no sudden decrease in the intensity of radiation was observed even after the passage of 1500 hours. The persistency ratio of the intensity of radiation stayed at a high level for a long time when compared to Lamp 1 to Lamp 5 in which Ar is enclosed. This result proved that a long longevity can be obtained.

Synthetically judging the results as set forth above, it can be appreciated that, in the short arc type mercury lamp in which Kr is enclosed as a rare gas, when the value of $d/d_0$ (i.e. $1-r/(d_0\times\tan\theta)$) is 0.66 or greater, the initial intensity of radiation is the same as or greater than that of the short arc type mercury lamp in which Ar is enclosed under the same enclosure pressure, and the persistency ratio of the intensity of radiation stays at a high level for a long time.

A description will be given below of an example.

Lamp Specification (2)

Material of light-emitting tube: quartz glass

Material of anode: tungsten

Configuration Dimension:

Diameter of maximum diameter portion: ϕ35 mm

Radius r of leading end surface: 4.4 mm

Inter-electrode distance $d_0$: 7.5 mm

Input power: 6.5 kW

Lamp current: 215 A

Hg density: 1.8 mg/cc

Sort of rare gas: Kr

Enclosure pressure (converted into positive pressure): 0.36 MPa (3.5 atm)

Angle of incline θ of taper surface: 60°

In the short arc type mercury lamp of an example which was fabricated according to the above-described specification, the value of $d/d_0$ (i.e., $1-r/(d_0\times\tan\theta)$) is 0.66.

The initial intensity of radiation and the persistency ratio of the intensity of radiation of this lamp were measured.

A lamp was fabricated as a lamp of a comparative example by substituting the enclosed rare gas from Kr in the lamp of an example according to the specification (2) into Ar. The lamp was lighted on under the same lighting conditions, and the initial intensity of radiation and the persistency ratio of the intensity of radiation were measured.

Figure 6:
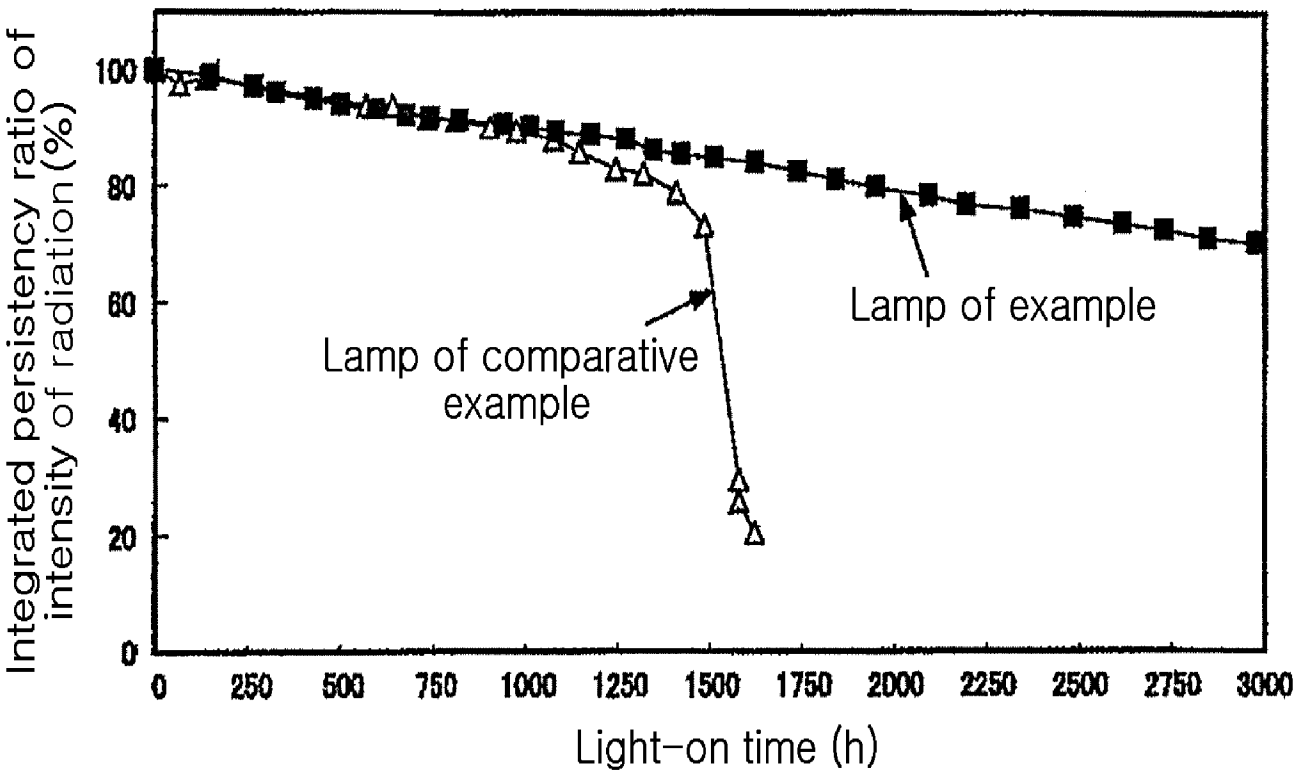
FIG. 6 is a graph showing the persistency ratio of the intensity of radiation of a lamp according to the present invention and a lamp according to a comparative example.

The results obtained by measuring the intensities of radiation of the lamp of an example and the lamp of a comparative example are presented in FIG. 6.

In the short arc type mercury lamp (indicated by Δ in the figure) of a comparative example, the intensity of radiation suddenly decreased to about 30% of the initial intensity of radiation as the light-on time has passed 1500 hours.

In the meantime, in the short arc type mercury lamp (indicated by ■ in the figure) of an example of the present invention in which Kr gas is enclosed, it was possible to obtain the initial intensity of radiation that is substantially the same as that of the lamp of a comparative example and maintain a high intensity of radiation that is at least 70% of the initial intensity of radiation even after the light-on time has passed 3000 hours.

As described above, in the short arc type mercury lamp, Kr is enclosed as a rare gas, and the ratio $d/d_0$ (i.e. $1-r/d_0\times\tan\theta$)) of the imaginary inter-electrode distance d with respect to the actual inter-electrode distance $d_0$ is set to be 0.66 or greater. Accordingly, the initial intensity of radiation that is the same or greater than that of the lamp in which Ar is enclosed can be obtained. Even after the light-on time has passed 3000 hours, the intensity of radiation does not exhibit a sudden decrease and still maintains a high intensity of radiation that is at least 70% of the initial intensity of radiation. A long longevity that is at least twice the longevity of the related art can be obtained.

Although the preferred embodiments of the present invention have been disclosed for illustrative purposes, those skilled in the art will appreciate that various modifications, additions and substitutions are possible, without departing from the scope and spirit of the present invention as disclosed in the accompanying claims.

What is claimed is:

1. A short arc mercury lamp, comprising a cathode and an anode disposed inside a light-emitting tube such that the cathode and the anode oppose each other, wherein Hg and a rare gas are enclosed inside the light-emitting tube, the enclosed rare gas includes Kr, the anode has a taper portion at a leading end side and a flat leading end surface on a leading end thereof, and the anode satisfies:

$$1-r/(d0\times\tan\theta)\geq 0.66,$$

where r (mm) is a radius of the leading end surface of the anode, θ (°) is an angle between an electrode axis and a taper surface in an axial cross-section of the anode, and d0 (mm) is a distance between the cathode and the anode.

* * * * *